United States Patent [19]

Bernardis et al.

[11] 4,169,683

[45] Oct. 2, 1979

[54] HIGH SPEED WIRE PRINTING DEVICE

[75] Inventors: Francesco Bernardis, Ivrea; Dario Bisone, Montalto Dora, both of Italy

[73] Assignee: Ing. C. Olivetti & C., S.p.A., Ivrea, Italy

[21] Appl. No.: 860,241

[22] Filed: Dec. 13, 1977

[30] Foreign Application Priority Data

Dec. 30, 1976 [IT] Italy ..... 70141 A/76

[51] Int. Cl.[2] ..... B41J 3/12

[52] U.S. Cl. ..... 400/124; 400/323

[58] Field of Search ..... 400/124, 323; 101/93.05; 364/900 MS File

[56] References Cited

U.S. PATENT DOCUMENTS 3,764,994 10/1973 Brooks et al. ..... 400/124 X 4,079,824 3/1978 Ku ..... 101/93.05 X

FOREIGN PATENT DOCUMENTS 2516835 10/1976 Fed. Rep. of Germany ..... 400/124

*Primary Examiner*—Paul T. Sewell

*Attorney, Agent, or Firm*—Schuyler, Birch, Swindler, McKie & Beckett

[57] ABSTRACT

A high-speed wire printing device wherein the wires are slidably mounted on a carriage movable in front of a recording medium and individually actuated by controlling electromagnets to print alphanumeric characters and graphic symbols on the medium in accordance with a dot matrix formed of lines and columns. The printing extremities of the wires are aligned on two side-by-side columns. At each actuation cycle of the electromagnets, the carriage is shifted at a constant speed in front of the medium by a distance that is substantially equal to twice the distance between two columns of the matrix. An electronic circuit for the actuation of the electromagnets actuates both selectively and alternately the wires arranged in two side-by-side columns.

1 Claim, 8 Drawing Figures

26
27
20
23

50
51
52
FP
OS
SR
SP
FC
FCR
53
54
SR
32A
67
66
PZ
63
AB
EL1
62
61
EL2
EL3
EL4
EL5
EL6
EL7
60
AB
56
32B
67
66
PZ
62
57
59
70
71

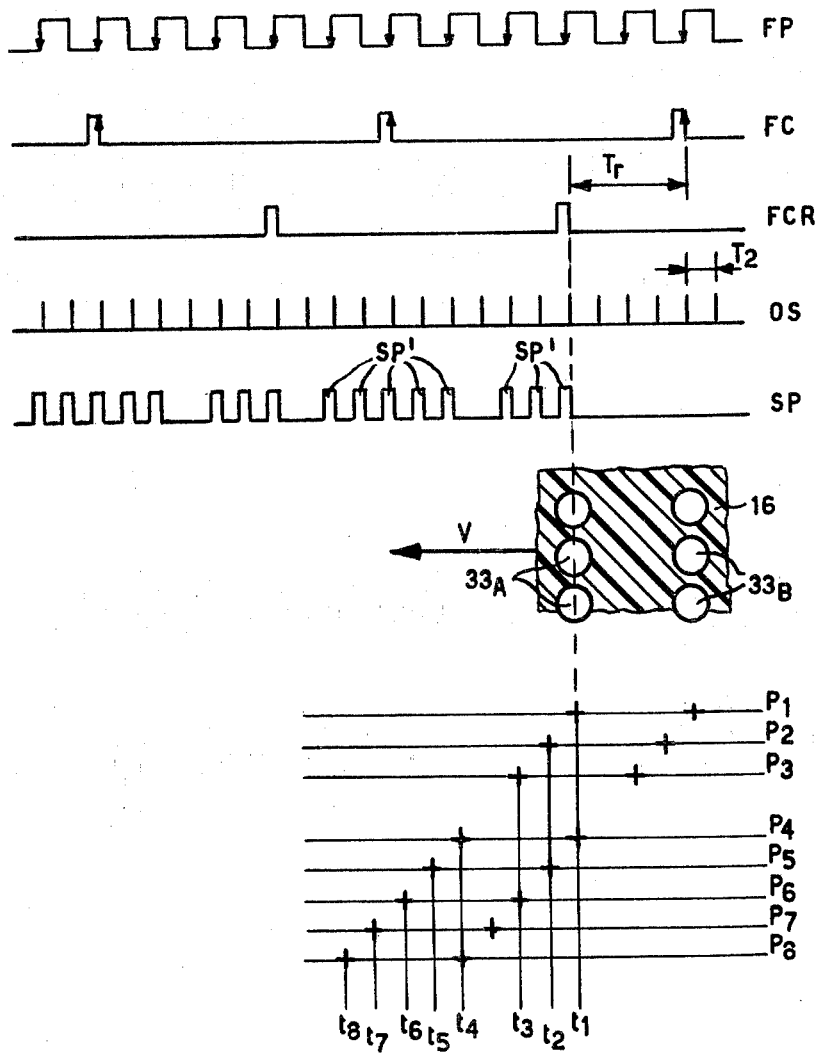
FIG. 8
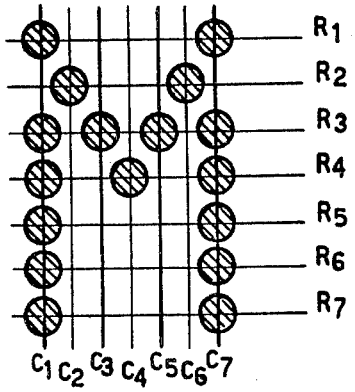

HIGH SPEED WIRE PRINTING DEVICE

BACKGROUND OF THE INVENTION

1. Field of the Invention

The present invention relates to a high-speed wire printing device for accounting machines, terminals, teleprinters, and similar office machines, wherein the wires are slidably mounted on a carriage movable in front of a recording medium and individually actuated by controlling electromagnets to print alphanumeric characters and graphic symbols on said medium in accordance with a dot matrix of lines and columns, and in which the printing extremities of the wires are aligned on two side-by-side columns.

2. Description of the Prior Art

A wire printing device is known wherein, in order to obtain a printed result in accordance with a 7×5 matrix, 14 wires are mounted in a free-running manner on a movable frame in front of a recording medium, the said wires being arranged in alignment on two side-by-side columns of seven wires each.

In such a device, the distance between the two columns of wires is equal to the distance between two columns of the dot matrix and the two columns of wires are activated simultaneously by a suitable controlled actuating circuit. This device has the disadvantage that the maximum absorbed power of the electromagnets is very high when all the wires of the two columns are actuated. In cases where the control of the electromagnets is governed by a program storage, the simultaneity of the actuation requires as many memory outlets as there are electromagnets or the employment of a further memory register.

SUMMARY OF THE INVENTION

The technical problem of the present invention is that of creating a dot printer capable of a high printing speed, and which has low current absorption and is at the same time both simple and reliable.

The device forming the object of the present invention solves this problem. According to the said invention, there is a shifting means which in each attuation cycle of the electromagnets moves the carriage at a constant speed through a distance that is substantially equal to twice the distance between two columns of the matrix, and an electronic circuit for the driving of the said electromagnets that actuates both selectively and alternately the wires arranged in two side-by-side columns.

BRIEF DESCRIPTION OF THE DRAWINGS

This and other features of the invention will be made clear in the following description of a preferred embodiment of the invention, such embodiment being presented by way of illustration only and without thereby limiting the scope of the invention, with reference to the accompanying drawings, wherein:

FIG. 8 is a timing diagram showing an example of the printing of the letter M during the movement of the head from right to left.

DESCRIPTION OF THE PREFERRED EMBODIMENT OF THE INVENTION

Figure 1:
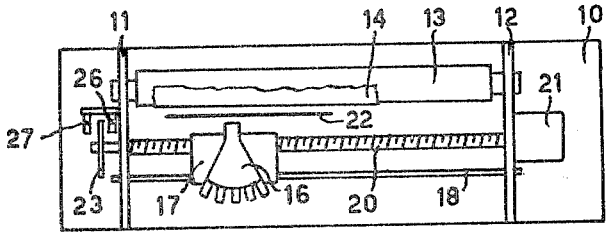
FIG. 1 is a plan view of a device according to the invention.

Referring to FIG. 1, the printing device according to the invention comprises a base 10 provided with two upright side frames 11 and 12, on which is mounted a printing platen 13 supporting a recording medium 14. The medium 14 may consist of a sheet of paper, a continuous form, cheques, or bank forms.

A wire printing head 16, which will be described in detail hereinafter, is mounted on a carriage 17, which runs on a guide 18 attached to the side frames 11 and 12 and is parallel to the platen 13.

The carriage 17 is shifted parallely to the platen 13 by means of a screw 20 rotatably mounted on the side frames 11 and 12 and is directly connected to an electric motor 21, for example a step-by-step motor, used to turn the screw.

An inked ribbon 22 is interposed between the printing head 16 and the platen 13.

A synchroniser disk 23 provided with a series of radial notches at the same angular distance from each other is splined on the screw 20. A phototransistor 26 is placed in front of the notches and works in conjunction with a corresponding light emitter 27. In particular, the phototransistor 26 is able to detect the elementary shifts of the head 16 along the printing line on the medium 14, which, in the case of dot matrix printing, correspond to the distance between two successive columns of the matrix.

Figure 2:
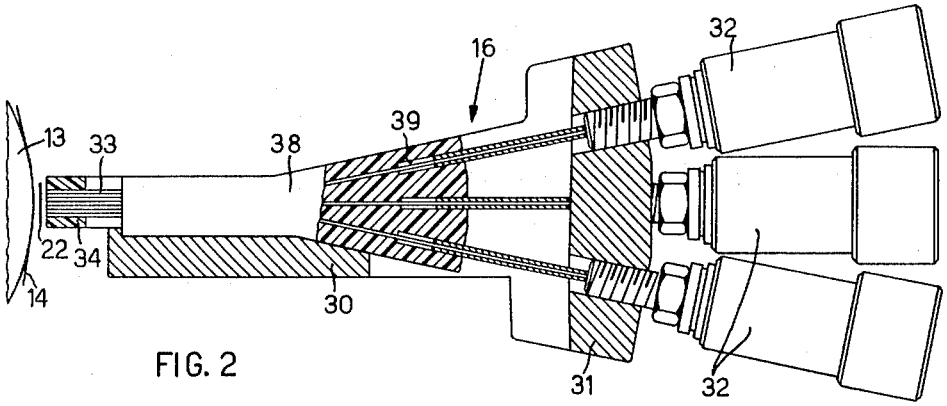
FIG. 2 is a left-hand side view, partially in section, of a printing head employed in the device according to the invention.
Figure 3:
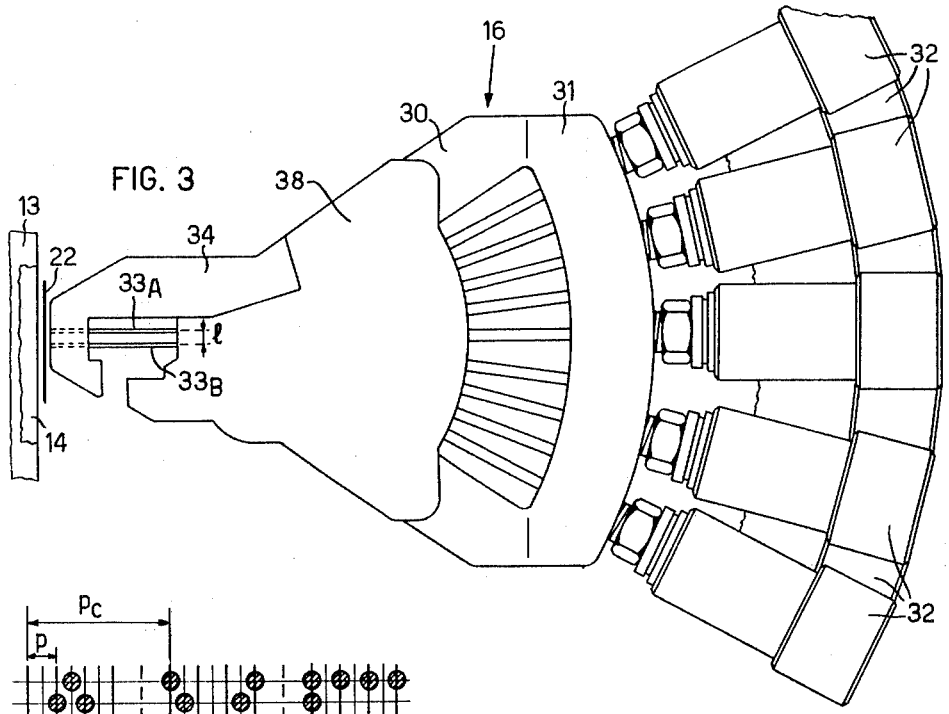
FIG. 3 is a plan view of the printing head of FIG. 2.

The head 16 (FIGS. 2 and 3) includes a frame 30 made of light alloy with a front rib 31 on which are mounted fourteen actuating electromagnets of known type, for example of the type described in U.S. Pat. No. 4,010,836 issued on Mar. 8, 1977. Each electromagnet 32 governs the axial shifting of a corresponding printing wire 33.

The wires 33 in the rear part of the head 16, that is to say near the printing platen 13, are aligned to form two vertical columns of seven wires each (column A and column B), and are guided by a terminal guide 34 supported by the frame 30 and constructed of a material with a high degree of hardness and resistance to wear. The printing wires 33 are about 0.3 mm in diameter, and the distance l between the two columns of wires is about 1.016 mm. The reason why this distance l has been chosen will be explained later.

The intermediate part of the wires 33, that is to say between the rib 31 of the frame 30 and the terminal guide 34, are guided by a single block 38 made of plastic, on which are formed, for example during the moulding stage, guide channels 39.

The printing device thus far described is capable of printing at high speed, for example 280 characters per second, in a serial manner and in accordance with a 9×7 dot matrix, alphanumeric characters and graphic symbols, during the movement of the carriage 17 from left to right, and during the return movement of the carriage 17 from right to left.

The reason why the distance l was chosen as 1.016 mm is as follows.

The printing density along a line is usually 10 characters per inch. It therefore follows that the pitch between two adjacent characters (character pitch) Pc is 2.54 mm. When a normal character font, for example, is used, this space is divided into five vertical columns (FIG. 6), each column being separated from the next by an elementary pitch distance of p=0.508 mm. The first four of said five columns are used to form the mesh bounding the matrix for the printing of dots to compose the character. The fifth column (left open and marked with a dashed line in FIG. 6) bounds the space between two adjacent characters.

Distance l is twice that between two columns of the matrix. The advantages offered by the choice of this distance will be described later.

The three intermediate columns of the four forming the matrix are employed for better definition of the printed characters. This means, in practical terms, that each character is printed in accordance with a mesh consisting of seven lines by seven columns.

The speed at which the motor 21 turns, and hence the translation speed of the head 16 in front of the platen 13, is selected in function of the time $T_1$ taken by the electromagnets to carry out a complete printing cycle and the elementary pitch p of the dot matrix.

Since a printing head with two columns of printing wires, such as that previously described, is shifted through two pitch distances p during $T_1$, and since in the case of electromagnets of known type the time $T_1$ is about 1400 μsec, it follows that the maximum translation speed abtainable is 725.6 mm/sec.

In practice, however, and in the particular form of embodiment here described, a slightly slower translation speed is employed, so that the head 16 takes a time slightly longer than $T_1$ to move through two pitch distances p. In precise terms, the head 16 shifts at 1400 p/sec, that is to say at about 711.2 mm/sec.

Figure 4:
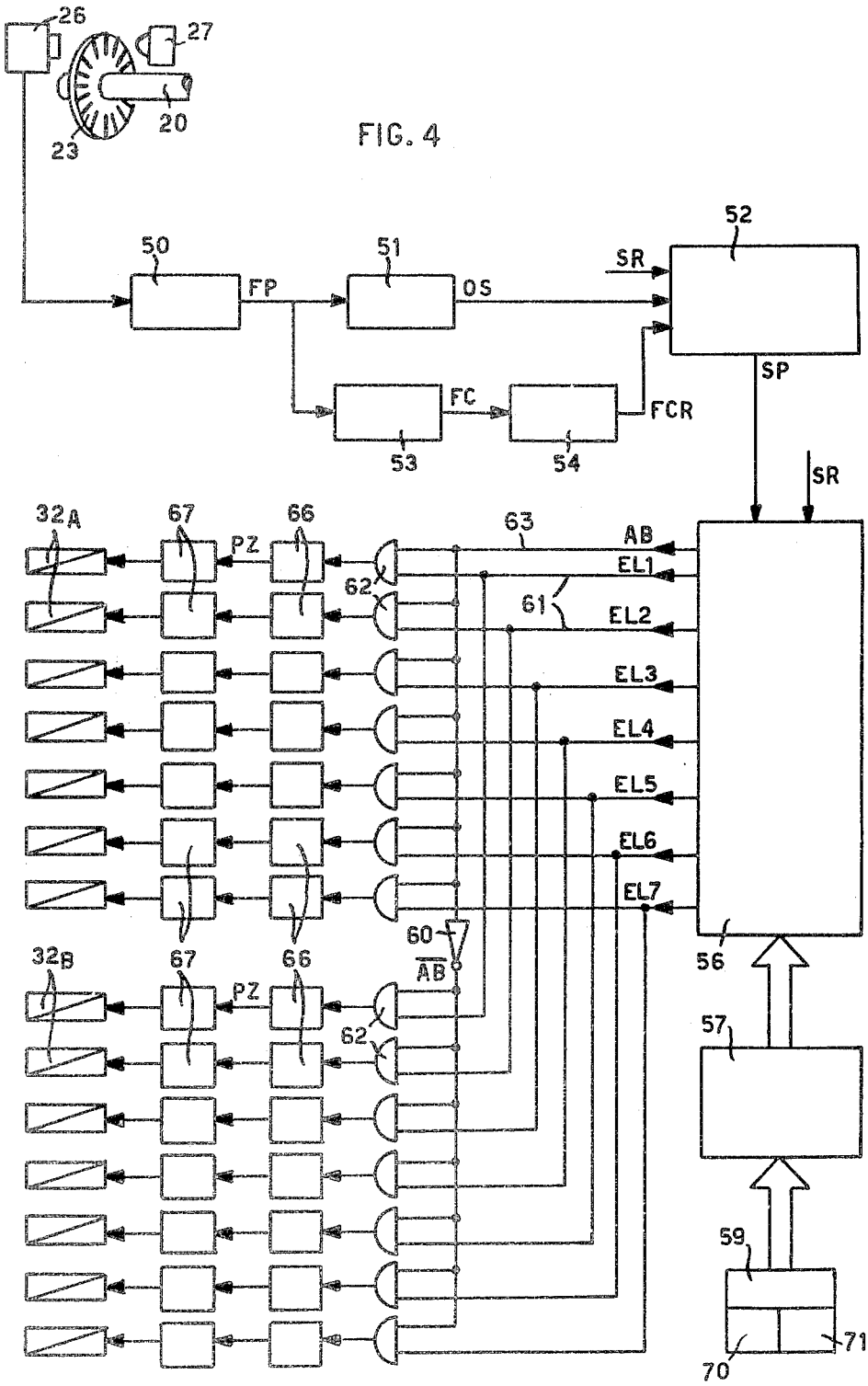
FIG. 4 is a general diagram of the control circuit for the printing head of the device according to the invention.

The general circuit governing the energisation of the actuation electromagnets 32 is illustrated in FIG. 4. It includes a squaring circuit 50, which squares the analogue signal from the phototransistor 26 and generates a signal FP.

Signal FP is at logic level 0 when the phototransistor 26 receives light emitted by the corresponding emitter 27, and at logic level 1 when the light beam is interrupted. Owing to the particular arrangement of the notches on disk 23, the time during which signal FP is at levels 1 and 0 is the same. In addition, the pulse frequency of signal FP is directly proportional to the speed at which the motor 21 turns, and hence to the translation speed of the head 16 in front of the platen 13. When the motor 21 is turning at its normal running speed, the said frequency is 1400 Hertz.

On leaving the squaring circuit 50, signal FP is sent to a single pulse generator 51 and a counter 53. The single pulse generator 51 generates a clock signal OS, which is normally at level 1 and moves to level 1 for each rising or falling edge of signal FP. The period $T_2$ of the pulses OS is of about 357 μs. Counter 53 generates a signal FC, which is normally at level 0 and moves to level 1 after every five falling edges of signal FP. Signal FC enters a delay circuit 54, which produces a signal FCR that is analogous to signal FC, but delayed with respect to the same by time $T_r$, equal to four OS signals.

Signal OS, signal FCR, and signal SR, which indicates the direction in which the motor 21 is turning, are sent to a sequencing circuit 52. The said circuit 52 generates a signal SP, which, during the ten clock pulses OS separating two FCR signals at level 1, consists of eight SP' pulses at logic level 1, these being the actual clock signals for the energisation of the electromagnets 32. In particular, the first SP' of each group, is generated coincidently with an FCR pulse and an OS pulse, and the subsequent SP' pulses are generated to correspond with the other nine OS pulses, with the exception of the sixt and tenth OS pulse. This sequence is generated when the head 16 shifts to print from left to right and the SR signal is at level 1.

When, on the other hand, the head 16 moves from right to left, signal SR is at logic level 0 and the series of SP' pulses is generated by the sequencing circuit 52 in the reverse sequence to that supplied when signal SR is at 1. In particular, (FIG. 8) the first SP' pulse of each series is generated to correspond with an OS pulse and an FCR pulse, and the subsequent SP' pulses are generated to correspond with the other nine OS pulses, with the exception of the fourth and tenth OS pulses.

Signal SP, together with signal SR, is sent to a decoding ROM 56, which receives the address of the character to be printed from a central unit 57. The data to be printed reach the central unit 57 from a buffer 59, connected, for example, to a keyboard 70 or another data entry unit 71.

ROM 56, in accordance with the code of the character to be printed, generates on seven wires 61 control signals EL1–EL7 at each clock pulse SP' to energise the electromagnets 32, and, on an eighth wire 63, a signal AB which, via a series of AND gates 62 and an inverter 60, addresses signal EL1–EL7 either to the electromagnets **32*a* actuating the printing wires of column A or to the electromagnets 32*b*** actuating the wires of column B.

Each control signal leaving the gates 62 is passed to a corresponding single pulse generator 66, which responds by generating a PZ pulse, which stays at logic level 1 for the time actually required to actuate the electromagnets 32 (about 700 μs). Pulse PZ is then sent to the corresponding electromagnet 32 via a drive circuit 67.

The operation of the printing device as thus far described is as follows.

Figure 5:
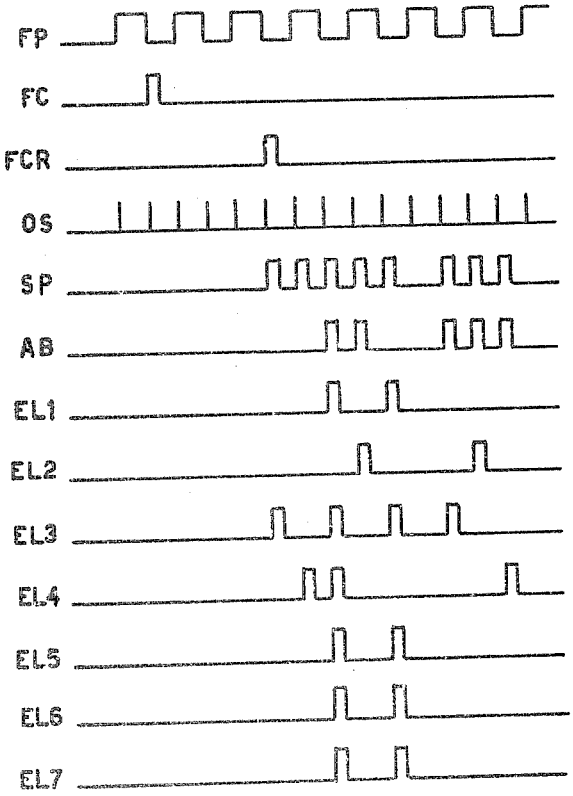
FIG. 5 is a timing diagram showing the pattern of some signals of the circuit shown in FIG. 4 during a particular operating situation.
Figure 7:
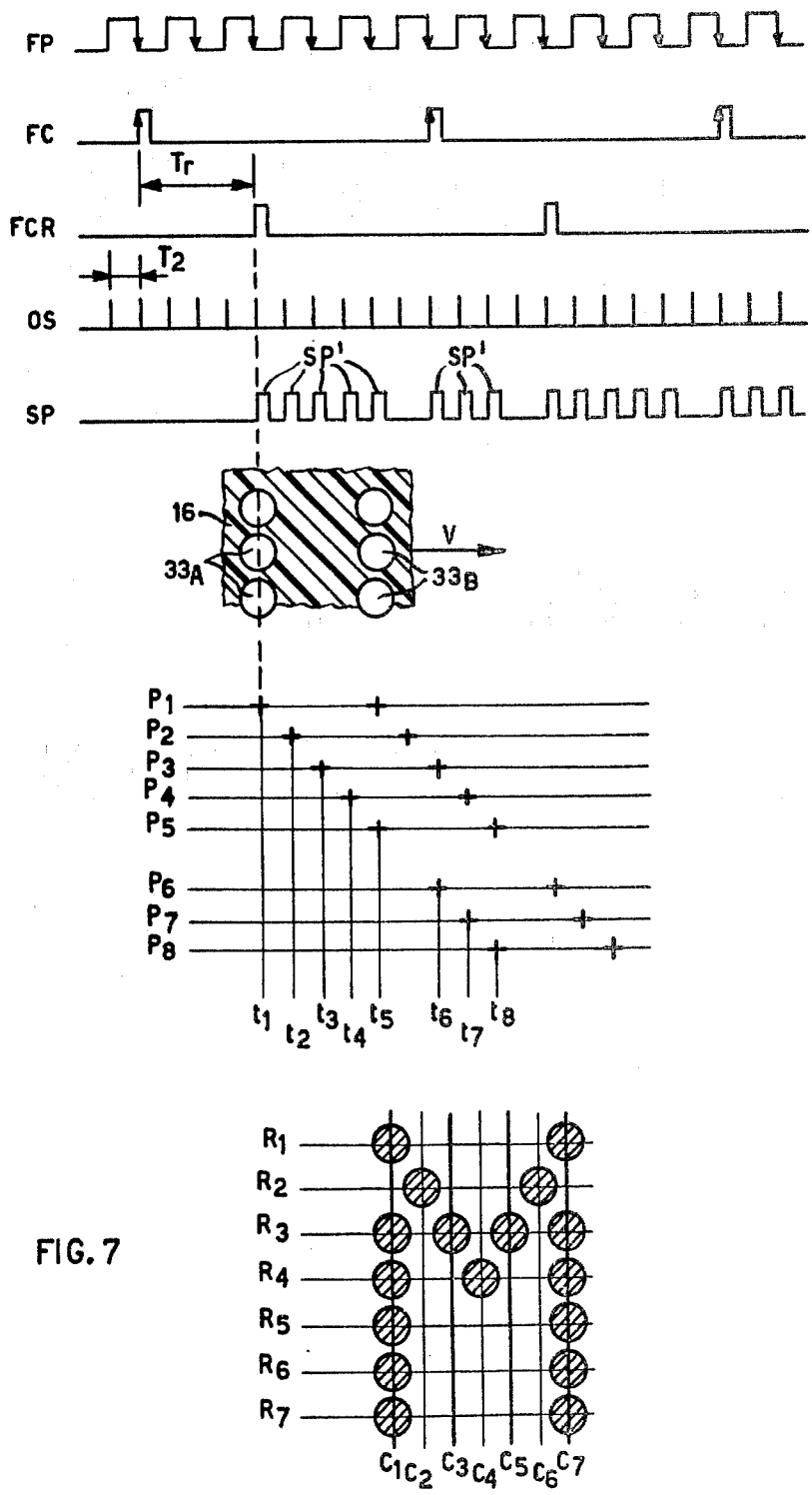
FIG. 7 is a timing diagram showing an example of the printing of the letter M during the movement of the head from left to right.

In the rest position, printing head 16 (FIG. 1) is fully to the left. Printing of one or more characters along a printing line commences by the supply of power to the motor 21, which actuates the translation of the head 16 in front of the platen 13. When motor 21 reaches its normal running speed (this usually occurs after a very short time), signal FP leaving the squaring circuit 50 is square in shape and has a frequency of 1400 Hz, as seen in FIGS. 5, 7 and 8. In particular, signal FP is at logic level 1 when the phototransistor 26 receives light from the light emitter 27. Signal SR is at level 1 because the head is moving from left to right.

Let us suppose that an instruction to print a letter, for example "M", is sent to the central unit via the buffer 59 from the keyboard 70 or the data entry unit 71.

The printing cycle for each character begins when an FC signal is generated, after every five falling edges of signal FP. The delayed signal FCR, on the other hand, is used for effective printing control. The FCR pulse delay time with respect to the FC pulses is equal to the time taken by four OS pulses, and has been chosen to ensure correct alignment of the printed characters when head 16 moves from left to right and those printed when head 16 moves from right to left. The SP' pulse train is generated by the sequencing circuit 52 in correspondence with pulse FCR.

At time $t_1$, when the first of the SP' pulses is generated, printing head 16 is in the first printing position $P_1$ (FIG. 7). Coincident with the said SP' pulse, ROM 56 leaves the AB signal at level 0 and brings about the energisation of the electromagnets connected to the wires of column B only. There is a time interval $T_3$ of about 850 μsec between the instant $t_1$ in which the said electromagnets are energised and that in which the wires connected to the same reach the medium 14.

Because the printing head 16 speed, when motor 21 is working at its normal running speed, is 711.2 m/sec, the head 16 travels about 0.6 mm during $T_3$. When the dots of column B are actuated, therefore, and head 16 is in position $P_1$, the corresponding dots are printed on column $C_3$ of the matrix. In the particular case of the letter M, the only electromagnet actuated is that connected to the wire that prints with respect to the third line $R_3$ of the matrix.

At instant $t_2$, when the second SP' pulse is generated, that is to say about 350 μsec after instant $t_1$, the head 16 is in the second printing position $P_2$. In this situation, signal AB remains at level 0, and those electromagnets of column B that were not actuated when the head 16 was in position $P_1$ can now be actuated. After the said period of 350 μsec, in fact, the electromagnets already actuated are not yet reached the end of their stroke cycle and can not be actuated again. In this second position $P_2$, only the wire that prints with respect to the fourth line $R_4$ of the matrix is actuated in order to print the letter M. Owing to the delay $T_3$ between energisation and impact, the dot is printed on the fourth column $C_4$ of the matrix.

At instant $t_3$, when the third SP' pulse is generated, that is to say about 350 μsec after instant $t_2$, the head 16 is in position $P_3$. At this point, signal AB moves to level 1 and as a result the electromagnets connected to the wires of column A are made ready for energisation. In this situation, the wires that print the dots of lines $R_1$, $R_3$, $R_4$, $R_5$, $R_6$ and $R_7$ are actuated in the case of letter M. Owing to the delay $T_3$ between the energisation of the wires and their impact, the dots are printed on column $C_1$ of the matrix.

At instant $t_4$, when the fourth SP' pulse is generated, that is to say about 350 μsec after instant $t_3$, the head 16 is in position $P_4$. At this point, signal AB is at level 1, and as a result the electromagnets of column A that were not actuated previously can now be actuated. In the particular case of letter M, the electromagnet that causes the corresponding wire to print a dot on line $R_2$ is actuated. Owing to the delay $T_3$ between energisation and impact, the dot is printed on column $C_2$ of the matrix.

At instant $t_5$, when the fifth SP' pulse is generated, that is to say about 350 μsec after instant $t_4$ and a time $T=4T_2$ after instant $t_1$, the head 16 is in position $P_5$. At this point, signal AB stays at level 0 and the electromagnets connected to the wires of column B, except those actuated at instant $t_2$, which are not yet reached the end of their stroke cycle, are once again made ready for actuation. In the case of the letter M, the electromagnets connected to the wires that print on lines $R_1$, $R_3$, $R_5$, $R_6$ and $R_7$ are actuated, and the respective dots are printed on column $C_7$.

The sixth SP' pulse is generated at instant $t_6$, that is to say about 700 μsec after instant $t_5$, when head 16 is in the sixth printing position $P_6$, which is distant one pitch p with respect to the previous position $P_5$. At this point, signal AB moves to level 1, and the electromagnets connected to the wires of column A, with the exception of those actuated at instant $t_5$, which are not yet reached the end of their stroke cycle, are once again made ready for actuation. In the particular case of letter M, only the electromagnet connected to the wire that prints on line $R_3$ is actuated. Owing to the delay $T_3$ between energisation and impact, the dot is printed on column $C_5$.

The seventh SP' pulse is generated at instant $t_7$, that is to say about 350 μsec after instant $t_6$, when head 16 is in printing position $P_7$, the said position being one half-pitch P/2 distant from the previous position. At this point, signal AB is at level 1 and the electromagnets connected to column A are once again made ready for energisation. It will be obvious that the electromagnets that are still completing their stroke cycle cannot be energised in this manner. In the particular case of the letter M, only the electromagnet connected to the wire that prints on line $R_2$ is actuated. Owing to the delay $T_3$ between energisation and impact, the dot is printed on column $C_6$. The printing of the character is completed at instant $t_8$, that is to say about 350 μsec after instant $t_7$, by the generation of the eighth SP' pulse. At this point, signal AB is at level 1 and the head 16 is at the eighth printing position $P_8$. The electromagnet connected to the wire that prints a dot on line $R_4$ (after the delay period of $T_3$ after energisation), corresponding to column $C_7$ of the matrix, is actuated.

Once a character is printed, a new printing cycle of the same kind as that described is initiated by the generation of a further FCR pulse.

When the head 16 reaches the end of a line of print while moving from left to right, motor 21 goes into reverse and head 16 returns leftwards at a speed V equal and opposite to that employed during its rightward movement. Simultaneously a line feed movement is given to the medium 14. The device according to the present invention is able to print also during the return movement of the head 16 to the start position. In particular, the instants at which the electromagnets are energised have been chosen in such a way that the characters printed during the return movement are in perfect alignment with those printed when the head 16 moves from left to right. In the same manner as has already been described, when motor 21 is operating at its normal running speed, signal FP (FIG. 8) is once again square in shape and its frequency is 1400 Hz. Because the head 16 is to move from right to left, signal SR is at logic level 0.

The first FC pulse is generated coincident with the first falling edge of signal FP. The printing is, however, controlled by using the delayed signal FCR, which is generated by the delay circuit 54 at an interval Tr after signal FC.

The train of SP' pulses is generated by the sequencing circuit 52 to coincide with pulse FCR. At instant $t_1$, when the first SP' pulse is generated, printing head 16 is at the first printing position $P_1$ (FIG. 8).

Let us suppose that the instruction to print letter M is once again sent to the central unit 57 via the buffer 59 from the keyboard 70 or from the data entry unit 71.

When printing is carried out with head 16 moving from right to left, the energisation sequence directed to the electromangets 32 is the opposite of that supplied during the movement of the head 16 from left to right.

Figure 6:
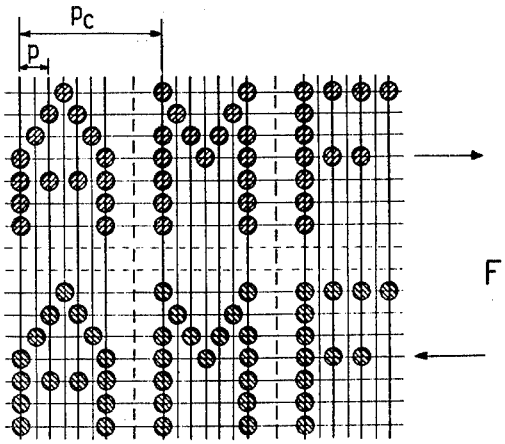
FIG. 6 is an illustrative representation of some characters printed by means of the device according to the invention.

In the particular case of letter M, when head 16 is in position $P_1$, the electromagnet connected to the column A wire, which prints on column $C_7$ and line $R_4$ is energised; when head 16 is at position $P_2$, the electromagnet connected to the column A wire, which prints on column $C_6$ and line $R_2$ is energised; when head 16 is at position $P_3$, the electromagnet connected to the column A wire, which prints on column $C_5$ and line $R_3$ is energised; when head 16 is in position $P_4$, the electromagnets connected to the column B wires, which print on $C_7$ and lines $R_1$, $R_3$, $R_5$, $R_6$ and $R_7$ are energised; when head 16 is at position $P_5$, the electromagnet connected to the column A wire, which prints on column $C_2$ and line $R_2$ is energised; when head 16 is at position $P_6$, the electromagnets connected to the column A wires, which print on column $C_1$ and lines $R_1$, $R_3$, $R_4$, $R_5$, $R_6$ and $R_7$ are energised; when head 16 is at position $P_7$, the electromagnet connected to the column B wire, which prints on column $C_4$ and line $R_4$ is energised; and, lastly, when head 16 is at position $P_8$, the electromagnet connected to the column B wire, which prints on column $C_3$ and line $R_3$ is energised. The delay time $T_r$ between pulse FC and pulse FCR ensures that characters printed during the movement of head 16 from left to right are perfectly aligned with those printed during the movement of the said head 16 from right to left, as shown in FIG. 6.

It is evident that the printing device thus far described can be modified or endowed with additional parts without thereby going outside the field of the present invention.

In particular, the translation speed of the head 16 for example, can be reduced to increase the reliability of the device and/or improve the printing quality.

Furthermore, the arrangement of the wires can be altered with reference to the medium 14, either by staggering the wires of the two columns with respect to each other, for example, or by inclining the said wires, so as to obtain a printed result with a more closely packed dot matrix. In addition, the number of wires in one of the two columns could, for example, be reduced for devices that only print certain character fonts.

Lastly, the circuit that operates the electromagnets can be altered to obtain a different energisation sequence, which permits the printing of a font of characters different from that described herein before.

What we claim is:

1. A high-speed wire printing device for printing a dot matrix of characters on a recording medium, said device comprising a carriage, a plurality of printing wires mounted on said carriage and actuatable for the printing of said dot matrix, said wires having printing ends aligned on two sides by side columns, a plurality of electromagnets associated with said wires for the actuation thereof, said electromagnets having an actuation cycle of a predetermined time, moving means for moving said carriage in front of said recording medium at a substantially constant speed so that during said predetermined time said carriage traverses a space substantially equal to twice the distance between two columns of said matrix, and an electronic circuit associated with said electromagnets for actuating both selectively and alternately the two side-by-side columns of printing wires, wherein said electronic circuit comprises a memory unit, in which are stored the sequence of commands of said electromagnets, means for sequentially reading the content of said memory unit, decoding means for selectively actuating said electromagnets in response to said commands, and selecting means which generate a selecting signal for selectively actuating the electromagnets of one of the two columns of wires, wherein said decoding means is provided with a series of outputs each of which is connected to a pair of gates, each one of said gates being associated with one of said electromagnets for the operation of said wires, wherein the electromagnets operating the wires of one predetermined column are activated by the signals of said outputs in response to said selecting signal emitted by said selecting means, wherein an inverting means is provided for generating an inverted signal of said selecting signal and wherein the gates of the electromagnets for one column are operated directly by said selecting signal, while the gates of the electromagnets of the other column are operated by said inverted signal.

* * * * *